US006836251B2

(12) United States Patent
Reichelt

(10) Patent No.: US 6,836,251 B2
(45) Date of Patent: Dec. 28, 2004

(54) RADIO ANTENNA IN THE FORM OF A TRANSMITTING ANTENNA OR A RECEIVING ANTENNA, AND RADIO MOBILE SYSTEM

(75) Inventor: Helmut Reichelt, Dresden (DE)

(73) Assignee: Moletherm Holding AG, Solothurn (CH)

( * ) Notice: Subject to any disclaimer, the term of this patent is extended or adjusted under 35 U.S.C. 154(b) by 0 days.

(21) Appl. No.: 10/415,392

(22) PCT Filed: Sep. 6, 2001

(86) PCT No.: PCT/EP01/10273

§ 371 (c)(1),
(2), (4) Date: Sep. 9, 2003

(87) PCT Pub. No.: WO02/37604

PCT Pub. Date: May 10, 2002

(65) Prior Publication Data

US 2004/0046700 A1 Mar. 11, 2004

(30) Foreign Application Priority Data

Oct. 31, 2000 (EP) ..... 001237171

(51) Int. Cl.[7] ..... H01Q 1/38

(52) U.S. Cl. ..... 343/700 MS; 455/90; 252/506

(58) Field of Search ..... 343/700 MS

(56) References Cited

U.S. PATENT DOCUMENTS

| | | | | |
|---|---|---|---|---|
| 6,097,339 | A | 8/2000 | Filipovic et al. | 343/702 |
| 6,231,619 | B1 * | 5/2001 | Florio et al. | 205/126 |
| 6,254,922 | B1 | 7/2001 | Reichelt | 427/58 |
| 6,341,057 | B1 * | 1/2002 | Nissen et al. | 361/502 |
| 6,440,331 | B1 * | 8/2002 | Carano et al. | 252/506 |
| 6,565,731 | B1 * | 5/2003 | Couble et al. | 205/125 |

* cited by examiner

*Primary Examiner*—James Vannucci
(74) *Attorney, Agent, or Firm*—McNair Law Firm, P.A.

(57) ABSTRACT

This invention relates to a radio antenna as a transmitting antenna or a receiving antenna and a mobile radio system. In accordance with the invention, the radio antenna (MS-A, BTS-A) is a planar antenna and consists of one carrier part (1) of an electrically insulating material, of a coating (s) applied thereon and of two spaced coating feeders (3, 4) having an electrical connection to the interstitial coating (2). This coating is made of a coating material, which consists of specific materials in indicated amounts of substances of one binding agent, insulator, dispersing agent and distilled water. By means of the coating (2), electromagnetic waves are transmittable or receivable with a high frequency selectivity being possible in combination with a spherical characteristic.

13 Claims, 2 Drawing Sheets

RADIO ANTENNA IN THE FORM OF A TRANSMITTING ANTENNA OR A RECEIVING ANTENNA, AND RADIO MOBILE SYSTEM

CROSS REFERENCE TO RELATED APPLICATIONS

This application claims priority from German Patent application SN 00123717.1 filed 31 Oct. 2000 and from PCT/EP01/10273 having an International Filing Date of 6 Sep. 2001.

FIELD OF THE INVENTION

This invention relates to a radio antenna as a transmitting antenna or receiving antenna and particularly to such antennas for a mobile radio system, and generally to a mobile radio system and particularly mobile station such as cellular phones.

BACKGROUND

Radio frequencies for radio communication begin in a frequency range of a few kHz. For the transmission of radio broadcasts, for example, frequencies between 520 kHz and 1,605.5 kH are used in the medium wave range; in the short-wave range frequencies between 5.9 MHz and 26.1 MHz, and in the ultra-shortwave range between 87.5 MHz and 108 MHz. For the transmission of television broadcasts, frequencies between 124 MHz and 790 MHz are used.

Ultra-high frequency ranges are used, among others, for mobile telephones with analog technology from 450 MHz to 465 MHz, and for the digital GSM (Global System for Mobile Communication) from 890 MHz to 960 MHz and 1,710 MHz to 1,880 MHz. Wireless telephones operate in a frequency range above that, from 1,180 MHz to 1,900 MHz. These ultra-high frequencies allow the use of relatively small antennas and guarantee a comparatively reliable connection for mobile communication.

Directional microwave connections currently use frequencies between 2 GHz to 40 GHz.

Radio frequencies are scarce resources and today, all reasonably usable frequencies are practically occupied already. One permanent objective will thus be to better use these limited radio frequencies available—through improvements in transmission engineering and improvements in modulation engineering for the highest possible rate of information transmission with a good transmission quality.

Furthermore, with regard to radio systems, there is a general demand for a simple, low-cost design, as well as an environmentally sound and the most energy-saving operation. These requirements are to be taken into account especially for a mobile radio system with mobile telephones (cellular phones).

A mobile radio system comprises, in a generally known manner, mobile stations (MS) as cell phones (cellular phones) for subscribers. Furthermore, a mobile radio system comprises base transceiver stations (BTS) each in one local area as a radio cell, with larger local areas divided into adjoining radio cells. The base transceiver stations handle radio traffic with the mobile stations. Several base transceiver stations (BTS) are allocated to one base station controller each (BSC) with which they are connected via data transfer and which control and coordinate the allocated base transceiver stations (BTS). Data transfer can here be done via copper lines or via radio, especially point-to-point radio systems.

Furthermore, several base station controllers (BSC) are in turn allocated to one mobile radio switching center (MSC). Data transfer can here again be done either via lines or via point-to-point radio systems.

For a high level of information transmission, a plurality of different modulation and demodulation procedures is used, such as, for example, the transmission on many small channels of small bandwidth with frequency multiplexing and/or time multiplexing, where however—due to transmission inaccuracies and for safeguarding the informational contents—safety spacings must be maintained, and also especially frequency safety spacings.

With standard antennas, the signal quality while transmitting and/or receiving can be negatively affected, among other things, due to antenna noise since they can be operated only to a limited extent in a frequency-selective manner and only with some sideband noise. This is one reason, among others, why the presently required safety spacings cannot be reduced at will.

Especially for mobile telephones (cellular phones), there is a demand for a low-weight compact design and energy-saving operation. The presently relatively great weight and size of the mobile phones are essentially due to the battery and, among other things, due to the filters for improving the signal quality.

Accordingly, it is one objective of the invention to propose a simply designed radio antenna as a broadband antenna which covers a large utilizable radio frequency range and which can be operated in transmitting and receiving mode with a high frequency-selective precision. Another objective of the invention consists of proposing a mobile radio system with the use of such a radio antenna.

The first objective is solved by the transmitting and receiving antennas as described and claimed herein, and the second objective by the mobile radio system that is described and claimed herein.

SUMMARY OF THE INVENTION

In one aspect, the radio antenna of the invention is a planar antenna comprising a carrier part, a coating applied thereto, and of two coating feeders.

The carrier part consists of an insulating material.

The coating preferably is composed of a coating material having the following composition:

a. 48% to 65% amount of substance of a basic substance comprising:
   36% to 46% amount of substance binding agent,
   12% to 22% amount of substance insulator,
   12% to 24% amount of substance dispersing agent,
   8% to 40% amount of substance distilled water and
b. 35% to 52% amount of substance graphite, the composition of the binding agent being
   64% to 79% amount of substance distilled water,
   4% to 6% amount of substance sulfonated oil,
   0.16% to 0.24% amount of substance phenols or 0.05% to 0.5% amount of substance benzisothiazolinone,
   17% to 22% amount of substance casein,
   0.8% to 1.2% amount of substance urea,
   2% to 6% amount of substance alkaline thinning agent, and
   2.3% to 2.8% amount of substance caprolactam.

Similarly electrically active coating materials are known in connection with radiation heating systems where heating effects in matter are to be produced through frequency emissions in the THz range via molecular resonance phenomena. In contrast, the instant coating material of this invention is especially designed for use in the—in turn—lower-frequency radio antenna range.

DESCRIPTION OF DRAWINGS

The invention is explained in more detail by means of the drawings.

Figure 4:
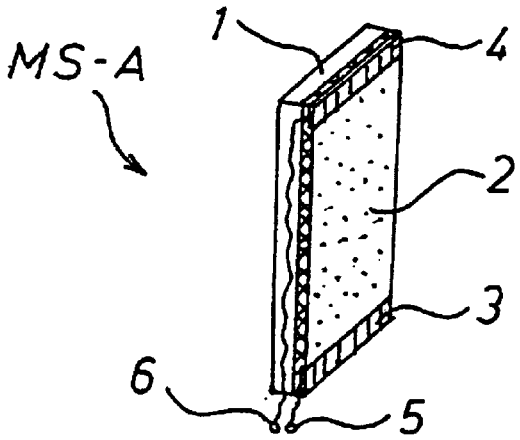
FIG. 4 is a schematic presentation of the antenna from FIG. 3.

DETAILED DESCRIPTION referring now to FIG. 4, coating feeders (3, 4) are at least two spaced electrical conductors of good electrically conducting material, having an electrical connection to the coating being in the interstice.

The coating feeders are connected with additional elements of the electromagnetic oscillating circuit, with electromagnetic waves being transmittable or receivable by means of the coating via its planar extension.

For the application of a uniform coating, the binding agent comprises distilled water, which makes the individual components mix well with each other. The sulfonated oil and, if necessary, a leveling agent are used as a solution mediator and effect a uniform distribution of the individual substances in the binding agent, as well as a good film formation of the coating material on the carrier part.

The phenols or benzisothiazolinones contained in the binding agent will favor—already in small amounts—the addition of particles. Casein is to be considered a binding agent within the binding agent and causes the addition of the individual components within the binding agent. Urea is also used as a solution mediator in the binding agent and favors the uniform distribution of the individual components. Additionally, a thinning agent used for homogenization as well as caprolactam as a structural substance are contained in the binding agent.

The basic substance comprises as a main component the binding agent to which the particles of the isolator will adhere. The dispersing agent facilitates dispersing and thus the uniform distribution of the binding agent together with the particles of the isolating agent in the basic substance. The added graphite also adds with its individual particles to the binding agent which already binds the insulator. Together with the insulator, a plurality of minutest electrical dipoles are thus being formed which are uniformly distributed in the coating material and thus in the finished coating applied. The arrangement principally presents a plurality of coupled, minutest harmonic and nonharmonic oscillators in the form of dipoles. Thus, a high degree of transmitting and receiving electromagnetic radiation results in the entire utilizable radio frequency range from a few KHz up to the GHz range with extremely high frequency selectivity.

Due to the high frequency selectivity, practically no sideband noise is emitted. It is accordingly advantageously possible to reduce the frequency security spacings so that available frequency ranges are better utilizable and thus a higher rate of information is transmittable. In terms of the technical side of the devices, filter equipment—especially active filters—can be saved or at least reduced. Since, moreover, a clean frequency signal without noise is being emitted, the energy otherwise required for noise emission, as well as the energy for the operation of filters for filtering off such noise can be saved. Thus, especially with mobile telephones, it is possible to operate with lower power input, possibly with smaller batteries and a longer operating period per battery charge.

The radio antenna in accordance with the invention surprisingly has a spherical emission characteristic without a pronounced directive efficiency. This too can be used for a reduction of the operating energy. With mobile telephones, this will moreover advantageously result in an improvement of electromagnetic compatibility since a certain specified emission power is distributed to all spatial directions and thus a concentration of the radiation power on the user's head area will be avoided.

The radio antenna in accordance with the invention can advantageously be used with all radio installations and radio systems with the aforementioned benefits, such as, for example, in radio station or television operation since—due to the broadband range and the high frequency selectivity over the total bandwidth—practically all usable radio frequencies can be covered. Adjustments to different performances can simply be done through dimensional adjustments.

Another feature of the invention is that the carrier part can be manufactured easily and at a low cost from a sturdy electrically insulating plastic. Basically, the radio antenna or, respectively, the carrier part can have different forms since the antenna effect is caused by a plurality of dipoles contained in the coating.

According to another part of the invention, however, it is expedient to design the carrier part in the form of plates to thus form a planar antenna. Active coating can then be applied, depending on the conditions, on one and/or of both sides of the surface. Even such a planar antenna has a spherical emission characteristic. Here, the possible transmission and receiving power is essentially given due to the coating surface lying between the allocated coating feeders, with the layer gauge here having a lower influence, which is, however, to be increased as well for higher performance.

In a further aspect, the carrier part can be an integrated component of a part of the outer wall of the housing, especially of a mobile station housing made of plastic—with an advantageously compact structure and simple manufacture thus being possible. Accordingly, it will no longer be required—as has been standard until now—to have a rod antenna protrude, for example, from a cellular phone housing.

For the coating, sulfonated oils can be used—such as, for example, sulfated olive oil, sulfated sesame oil or sulfated palm oil. In still another aspect, sulfated ricinus oil is preferably used which is known as sulforicinate or as Turkey red oil. It is well suitable especially due to its interfacially active properties.

Preferably, phenols are preferably carbonized phenols produced by cracking which have a particular suitability for particle addition. Instead of phenols, benzisothiazolinone is preferably to be used.

In an additional feature, the thinning agent is a solvent based on aromatics and/or alcohol and/or ester and/or ketone, e.g. terpene.

As an insulating agent, isolators known per se can be used. However, the the isolating agent preferably is isolating soot. This soot is advantageously added already in grind condition with a very small particle size. Accordingly, this will favor the uniform distribution of the soot in the basic substance and thus the development of a plurality of electrical dipoles in then coating material.

A dispersing agent—which facilitates the dispersal and thus the uniform distribution of the binding agent together with the particles of the insulator in the basic substance—is an organic, monomer and/or polymer substance.

The coating material may contain a thixotropic agent in a another preferred preferred form of embodiment. This thixotropic agent causes the coating material to have a viscous consistency, i.e. it can be easily brushed when applying it to the carrier part, and, on the other hand, in a quiescent condition, it will be so tough that no drops or tears will form on the surface. Accordingly, precise contour application of the coating material on the carrier part will be possible.

In yet another preferred embodiment, the coating feeders are parallel-aligned copper foil strips, and the coating is applied, for providing an electrical connection, under or above the copper foil strips, or they are embedded in the coating. Thus, especially an inductive and/or capacitative coupling will be achieved.

To protect the coating and/or the coating feeders against environmental effects, it is preferred to apply a protective layer thereon. This can be designed as a final covering layer of the coating or it can consist of a protective film known per se. The effect of the antenna will not be influenced by such a cover.

Figure 3:
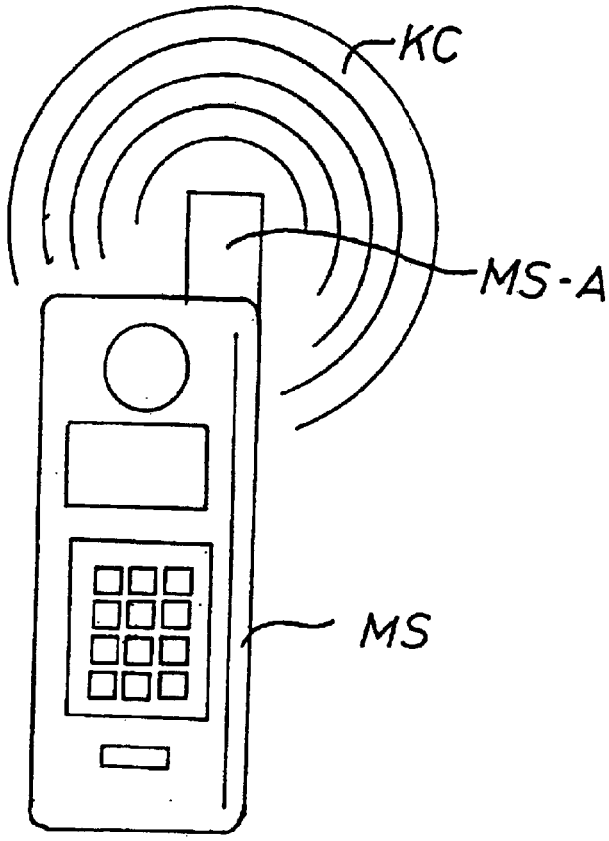
FIG. 3 is a mobile station as a mobile telephone (cellular phone) with a planar antenna having spherical characteristics.

Turning now to FIG. 3, a mobile radio system is shown that comprises mobile stations (MS) as cellular phones for subscribers and of base transceiver stations (BTS) in one area each as a radio cell which handles the radio traffic with the mobile stations (MS). Several base transceiver stations (BTS) are allocated to each one base station controller (BSC). Data communication can here be done via data lines or by radio. Several base station controllers (BSC), in turn, are allocated to a mobile switching center (MSC), here again the data communication being conducted either via stationary lines or via radio, especially point-to-point radio systems.

The above specified radio antenna designs are particularly advantageous in combination with mobile stations (MS) in the manner of mobile telephones and cellular phones. Also, such radio antennas with larger dimensions and approximately the same benefits can be used with base transceiver stations (BTS), base station controllers (BSC) and, as needed, with mobile switching centers (MSC).

As already detailed, the aforementioned specified radio antennas are, however, also utilizable with other radio systems, such as, for example, in radio or television operation, as well as in satellite communication traffic with excellent results.

Figure 1:
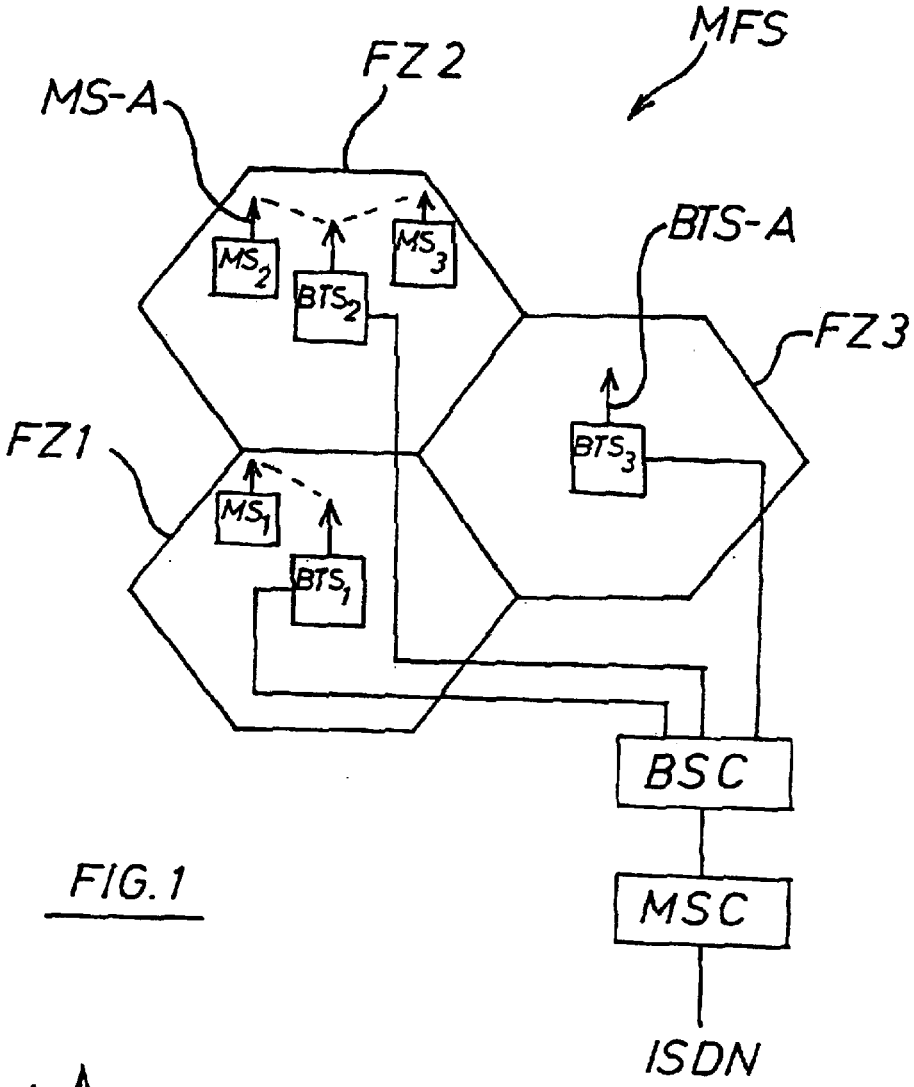
FIG. 1 is a schematic presentation of a mobile radio system.

Referring again to the drawings, FIG. 1 is presented as a schematic of a mobile radio system, with one mobile radio area being divided into individual area-wide radio cells, of which three adjoining radio cells FZ 1, FZ 2 and FZ 3 are being schematically presented. In each radio cell FZ 1, FZ 2 and FZ 3, a base transceiver station BTS 1, BTS 2 and BTS 3 is arranged. These base transceiver stations BTS 1, BTS 2 and BTS 3 handle the radio communication traffic with the mobile stations in the allocated radio cells FZ 1, FZ 2 and FZ 3. Here, one mobile station MS 1 is schematically presented in radio cell FZ 1, and in radio cell FZ 2, two mobile stations MS 2 and MS 3 are schematically presented. Base transceiver stations BTS 1, BTS 2 and BTS 3 are connected with a base station controller (BSC) to which a mobile switching center MSC is connected in series. On mobile stations MS 1, MS 2 and MS 3, as well as on the base transceiver stations BTS 1, BTS 2 and BTS 3, the particularly frequency-selective antennas MS-A and BTS-A in accordance with the invention are here respectively used.

Figure 2:
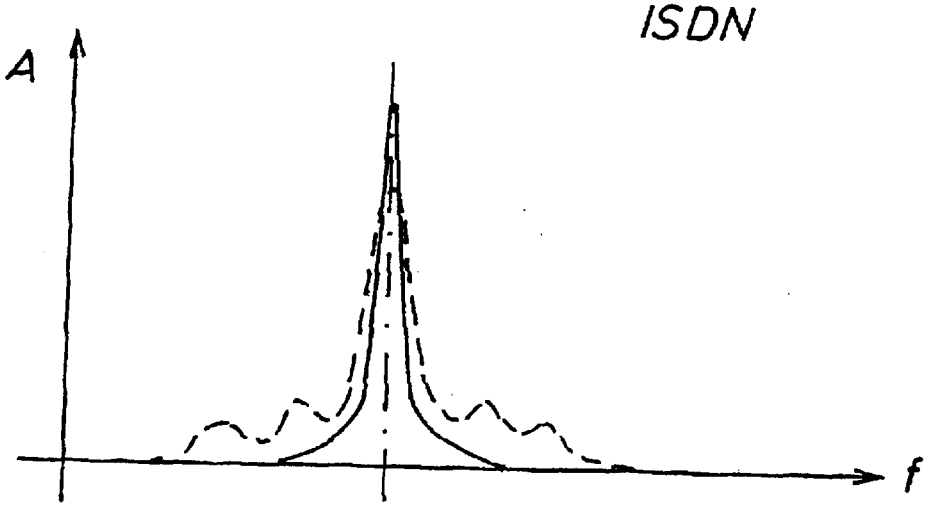
FIG. 2 is a presentation of a transmission signal.

In FIG. 2, a solid line schematically presents a clean and frequency-selective carrier frequency signal emitted from such an antenna. In turn, a dotted line shows a signal with sideband noise such as it is emitted by standard antennas. Corresponding conditions are also given for the reception.

FIG. 3 presents a mobile telephone of usual design, as a mobile station MS with a planar antenna MS-A and with a design described above. Moreover, the spherical transmission and receiving characteristic KC is indicated.

In a schematic presentation, FIG. 4 shows the structure of the radio antenna MS-A: On a plate-shaped carrier part 1 of plastic, a coating 2 of the specified coating material is here applied on one side. As coating feeders, parallel running copper foil strips 3, 4 are here used which have electrical contact with the coating 2. The cooper foil strips 3, 4 are connected with additional lines 5, 6 with an electronic system connected in series.

It is to be expected that upon reading the foregoing specification and viewing the drawings that other embodiments of my invention may become apparent but the invention is limited only by the scope of the claim appended hereto.

I claim:

1. Radio antenna as a transmitting antenna or as a receiving antenna, especially for a mobile radio system (with the radio antenna) being connectable to a transmission unit or to a reception unit and as a broadband antenna thus being a component part of a frequency-selective electromagnetic oscillating circuit operating on a correspondingly current radio frequency, comprising:

1) a planar radio antenna (MS-A, BTS-A) that comprises a carrier part (1), a coating (2) applied thereon and two coating feeders (3, 4), 2) the carrier part (1) comprising an electrically isolating material, 3) the coating (2) comprising a coating material which comprises:

a) 48% to 65% by weight of an amount of substance of a basic substance comprising by weight:

i) 36% to 46% amount of substance binding agent, ii) 12% to 22% amount of substance insulator, iii) 12% to 24% amount of substance dispersing agent, iv) 8% to 40% amount of substance distilled water, and b) 35% to 52% amount of substance graphite, the composition of the binding agent being i) 64% to 79% amount of substance distilled water, ii) 4% to 6% amount of substance sulfonated oil, iii) 0.16% to 0.24% amount of substance phenols or 0.05% to 0.5% amount of substance benzisothiazolinone, iv) 17% to 22% amount of substance casein, v) 0.8% to 1.2% amount of substance urea, vi) 2% to 6% amount of substance alkaline thinning agent, and vii) 2.3% to 2.8% amount of substance caprolactam, said coating feeders (3, 4) comprising at least two spaced electrical conductors made of an electrically highly conductive material sandwhich having an electrical connection to the interfacial coating (s), and said coating feeders (3, 4) being combinable with additional elements of the electromagnetic oscillating circuit (5, 6), with electromagnetic waves being transmittable or receivable by means of the coating (2) via its planar extension.

2. A radio antenna according to claim 1, wherein the carrier part (1) is made of sturdy plastic.

3. The radio antenna according to claim 1, wherein the carrier part (a) is designed in plate shape and thus the radio antenna (MS-A, BTS-A) is formed as a planar antenna and that a coating (2) with allocated coating feeders (3, 4) is applied on one and/or on both surface sides.

4. The radio antenna according to claim 3, wherein the carrier part (a) is an integrated component of one part of a housing outer wall, especially of a mobile station housing (cellular phone housing) made of plastic.

5. The radio antenna according to claim 4, wherein the sulfonated oil is preferably sulfated ricinus oil.

6. The radio antenna according to claim 5, wherein the phenols are carbonized phenols produced by cracking or that preferably benzisothiazolinone is used.

7. The radio antenna according to claim 6, wherein the thinning agent is a solvent based on aromatics and/or alcohol and/or ester and/or ketone.

8. The radio antenna according to claim 7, wherein the insulator is insulating soot.

9. The radio antenna according to claim 8, wherein the dispersing agent is an inorganic and/or organic, monomer and/or polymer substance.

10. The radio antenna according to claim 9, wherein the coating material contains a thixotropic agent.

11. The radio antenna according to claim 10, wherein the coating feeders are parallel aligned copper foil strips (3, 4) and the coating (2) contacts under or over the copper foil strips (3, 4) or that they are embedded in the coating.

12. The radio antenna according to claim 11, wherein a protective layer is applied above the coating (2) and/or the coating feeders (3, 4).

13. A mobile radio system, comprising a) at least one mobile stations (MS) as cellular phones for subscribers, b) at least one base transceiver stations (BTS) in a defined area such as a radio cell (FZ) with each handling the radio communication traffic with the mobile stations (MS), c) a plurality of base station station controllers (BSC), each of which are allocated each to several base transceiver stations (BTS) and are connected with said station via data transfer and which control and coordinate the allocated base transceiver stations (BTS), and d) a plurality of mobile switching centers (MSC) which are connected each with several base station controllers (BSC) via data transfer and which manage said center and, e) a radio antenna (MS-A, BTS-A) according to claim 1 being used in at least one mobile station (MS) and at least one base transceiver station (BTS) one base station controller (BSC) or in at least one mobile switching center (MSC).

* * * * *